US005356551A

United States Patent [19]

Chung et al.

[11] Patent Number: 5,356,551

[45] Date of Patent: Oct. 18, 1994

[54] MULTIFUNCTIONAL VISCOSITY INDEX IMPROVER FOR LUBRICATING OIL COMPOSITIONS

[75] Inventors: David Y. Chung, Edison; John E. Johnston, Westfield, both of N.J.

[73] Assignee: Exxon Chemical Patents Inc., Linden, N.J.

[21] Appl. No.: 878,084

[22] Filed: Dec. 20, 1991

Related U.S. Application Data

[63] Continuation of Ser. No. 220,310, Jul. 18, 1988, abandoned.

[51] Int. Cl.[5] ..... C10M 105/22; C10M 133/52

[52] U.S. Cl. ..... 252/51.5 A; 525/301; 525/374; 525/386

[58] Field of Search ..... 252/51.5 A, 33, 47.5, 252/56 R; 525/301, 385, 386, 376

[56] References Cited

U.S. PATENT DOCUMENTS

| | | | |
|---|---|---|---|
| 3,326,804 | 6/1967 | Hu | 252/34 |
| 4,051,049 | 9/1977 | Elliott et al. | 252/51.5 A |
| 4,089,794 | 5/1978 | Engel et al. | 252/51.5 A |
| 4,137,185 | 1/1979 | Gardiner et al. | 252/51.5 A |
| 4,144,181 | 3/1979 | Elliott et al. | 252/33 |
| 4,146,489 | 3/1979 | Stambaugh et al. | 44/63 |
| 4,160,739 | 7/1979 | Stambaugh et al. | 252/51.5 A |
| 4,161,452 | 7/1979 | Stambaugh et al. | 252/51.5 A |
| 4,219,432 | 8/1980 | Girgenti et al. | 252/51.5 A |
| 4,234,435 | 11/1980 | Meinhardt et al. | 252/51.5 |
| 4,320,019 | 3/1982 | Hayashi | 252/51.5 A |
| 4,372,863 | 2/1983 | Elliott et al. | 252/51.5 A |
| 4,375,974 | 3/1983 | Maldonado et al. | 252/51.5 A |
| 4,517,104 | 5/1985 | Bloch et al. | 252/51.5 A |
| 4,632,769 | 12/1986 | Guiterrez et al. | 252/51.5 A |
| 4,637,886 | 1/1987 | Brois et al. | 252/51.5 A |
| 4,670,173 | 6/1987 | Hayashi et al. | 252/51.5 A |
| 4,686,054 | 8/1987 | Wisotsky et al. | 252/51.5 A |
| 4,707,285 | 11/1987 | Brewster et al. | 252/51.5 A |
| 4,803,003 | 2/1989 | Chung | 252/51.5 A |

FOREIGN PATENT DOCUMENTS 0264247 4/1988 European Pat. Off. .

*Primary Examiner*—Margaret Medley
*Attorney, Agent, or Firm*—T. V. Kowalchyn

[57] ABSTRACT

Oleaginous compositions, particularly lubricating oil compositions, exhibiting improved low temperature viscometric properties containing a viscosity index improving amount of a V.I.-dispersant comprised of the reaction products of:

(a) an oil soluble ethylene copolymer comprising from about 15 to 90 wt. % ethylene and from about 10 to 85 wt. % of at least one $C_3$ to $C_{28}$ alpha-olefin, having a number average molecular weight of from about 5,000 to 500,000, grafted with an ethylenically unsaturated carboxylic acid material having 1 or 2 acid or anhydride moieties;

(b) an organic polyamine having at least two primary amino groups or a polyol; and (c) an amount effective to provide a V.I. improver-dispersant exhibiting improved low temperature viscometric properties of high functionality long chain hydrocarbyl substituted dicarboxylic acid material having a functionality of at least 1.2.

27 Claims, No Drawings

MULTIFUNCTIONAL VISCOSITY INDEX IMPROVER FOR LUBRICATING OIL COMPOSITIONS

This is a 37 C.F.R. 1.62 continuation of U.S. Ser. No. 220,310, now abandoned, which was filed Jul. 18, 1988.

BACKGROUND OF THE INVENTION

The concept of derivatizing viscosity index (V.I.) improving high molecular weight ethylene copolymers with acid moieties such as maleic anhydride, followed by reaction with an amine to form a V.I.-dispersant oil additive is known in the art and is described in the patent literature. This concept is described, for example, in the following patents:

U.S. Pat. No. 3,316,177 teaches ethylene copolymers such as ethylene-propylene, or ethylene-propylene-diene, which are heated to elevated temperatures in the presence of oxygen so as to oxidize the polymer and cause its reaction with maleic anhydride which is present during the oxidation. The resulting polymer can then be reacted with alkylene polyamines.

U.S. Pat. No. 3,326,804 teaches reacting ethylene copolymers with oxygen or ozone, to form a hydroperoxidized polymer, which is grafted with maleic anhydride followed by reaction with polyalkylene polyamines.

U.S. Pat. No. 4,089,794 teaches grafting the ethylene copolymer with maleic anhydride using peroxide in a lubricating oil solution, wherein the grafting is preferably carried out under nitrogen, followed by reaction with polyamine.

U.S. Pat. No. 4,137,185 teaches reacting $C_1$ to $C_{30}$ mono carboxylic acid anhydrides, and dicarboxylic acid anhydrides, such as acetic anhydride, succinic anhydride, etc. with an ethylene copolymer reacted with maleic anhydride and a polyalkylene polyamine to inhibit cross linking and viscosity increase due to further reaction of any primary amine groups which were initially unreacted.

U.S. Pat. No. 4,144,181 is similar to U.S. Pat. No. 4,137,185 in that it teaches using a sulfonic acid to inactivate the remaining primary amine groups when a maleic anhydride grafted ethylene-propylene copolymer is reacted with a polyamine.

U.S. Pat. No. 4,169,063 reacts an ethylene copolymer in the absence of oxygen and chlorine at temperatures of 150° C. to 250° C. with maleic anhydride followed by reaction with polyamine.

A number of prior disclosures teach avoiding the use of polyamine having two primary amine groups to thereby reduce cross-linking problems which become more of a problem as the number of amine moieties added to the polymer molecule is increased in order to increase dispersancy.

German Published Application No. P3025274.5 teaches an ethylene copolymer reacted with maleic anhydride in oil using a long chain alkyl hetero or oxygen containing amine.

U.S. Pat. No. 4,132,661 grafts ethylene copolymer, using peroxide and/or air blowing, with maleic anhydride and then reacts with a primary-tertiary diamine.

U.S. Pat. No. 4,160,739 teaches an ethylene copolymer which is grafted, using a free radical technique, with alternating maleic anhydride and a second polymerizable monomer such as methacrylic acid, which materials are reacted with an amine having a single primary, or a single secondary, amine group.

U.S. Pat. No. 4,171,273 reacts an ethylene copolymer with maleic anhydride in the presence of a free radical initiator and then with mixtures of $C_4$ to $C_{12}$ n-alcohol and amine such as N-aminopropylmorpholine or dimethylamino propyl amine to form a V.I. dispersant pour depressant additive.

U.S. Pat. No. 4,219,432 teaches maleic anhydride grafted ethylene copolymer reacted with a mixture of an amine having only one primary group together with a second amine having two or more primary groups.

German published application No. 2753569.9 shows an ethylene copolymer reacted with maleic anhydride by a free radical technique and then reacted with an amine having a single primary group.

German published application No. 2845288 grafts maleic anhydride on an ethylene-propylene copolymer by thermal grafting at high temperatures and then reacts with amine having one primary group.

French published application No. 2423530 teaches the thermal reaction of an ethylene copolymer with maleic anhydride at 150° C. to 210° C. followed by reaction with an amine having one primary or secondary group.

The early patents such as U.S. Pat. Nos. 3,316,177 and 3,326,804 taught the general concept of grafting an ethylene-propylene copolymer with maleic anhydride and then reacting with a polyalkylene polyamine such as polyethylene amines. Subsequently, U.S. Pat. No. 4,089,794 was directed to using an oil solution for free radical peroxide grafting the ethylene copolymer with maleic anhydride and then reacting with the polyamine. This concept had the advantage that by using oil, the entire reaction could be carried out in an oil solution to form an oil concentrate, which is the commercial form in which such additives are sold. This was an advantage over using a volatile solvent for the reactions, which has to be subsequently removed and replaced by oil to form a concentrate. Subsequently, in operating at higher polyamine levels in order to further increase the dispersing effect, increased problems occurred with the unreacted amine groups cross-linking and thereby causing viscosity increase of the oil concentrate during storage and subsequent formation of haze and in some instances gelling. Even though one or more moles of the ethylene polyamine was used per mole of maleic anhydride during imide formation, cross-linking became more of a problem as the nitrogen content of the polymers was increased. One solution was to use the polyamines and then to react the remaining primary amino groups with an acid anhydride, preferably acetic anhydride, of U.S. Pat. No. 4,137,185 or the sulfonic acid of U.S. Pat. No. 4,144,181. The cross-linking problem could also be minimized by avoidance of the ethylene polyamines and instead using amines having one primary group which would react with the maleic anhydride while the other amino groups would be tertiary groups which were substantially unreactive. Patents or published applications showing the use of such primary tertiary amines noted above are U.S. Pat. No. 4,219,432, wherein a part of the polyamine was replaced with a primary tertiary amine; U.S. Pat. No. 4,132,661; U.S. Pat. No. 4,160,739; U.S. Pat. No. 4,171,273; German No. P2753569.9; German No. 2,845,288; and French No. 2,423,530.

Still another problem which arose when using free radical initiators with mineral oil as the grafting medium is that as the grafting levels were increased to increase the dispersancy level, a larger proportion of the oil molecules in turn became grafted with the maleic anhydride. Then upon subsequent reaction with the amine these grafted oil particles tended to become insoluble and to form haze. To avoid using initiators, such as peroxides, for grafting and to avoid the use of oil, several of the above-noted patents utilized thermal grafting in solvent, preferably while using an ethylene copolymer containing a diene monomer so as to achieve an "ene" type reaction between the unsaturation resulting from the diene moiety and the maleic anhydride. However, generally such "ene" reactions are slower and less efficient than peroxide grafting.

U.S. Pat. No. 4,517,104 represents a further improvement over the art in that it permits the utilization of the generally less expensive polyalkylene polyamines having two primary amine groups, while achieving good dispersancy levels, inhibiting cross-linking and allowing initiator, e.g. peroxide, grafting in oil. This can be obtained by reacting the polymer grafted with the maleic anhydride with an acid component, such as an alkenyl succinic anhydride, together with the polyalkylene polyamine, e.g. polyethyleneamine, or with the reaction product of the acid component and the polyalkylene polyamine. In either case cross-linking between ethylene copolymer molecules is reduced or inhibited since many of the polyamine molecules will have one primary group reacted with a maleic anhydride moiety of the ethylene copolymer while its other primary amine group is reacted with the acid component. A further advantage is that when the grafting is carried out in an oil solution using a free radical initiator, e.g. a peroxide, which is generally much faster with better control than depending upon thermal cracking or degradation, oil molecules which become grafted with maleic anhydride and reacted with the amine will, to a substantial extent, be solubilized if a long chain acid component is used.

While the V.I. improver-dispersants and oil compositions containing these V.I.-dispersants disclosed in U.S. Pat. No. 4,517,104 are generally quite useful and advantageous there nevertheless exist certain situations which require oil compositions containing these types of V.I.-dispersants exhibiting improved, i.e., reduced, low temperature viscosity as measured, for example, in the cold cranking simulator (CCS), ASTM D2602, than exhibited by oil compositions containing these prior art V.I. improver-dispersants. The improved low temperature viscosity is intended to facilitate engine starting in cold weather and to ensure pumpability, i.e., the cold oil should readily flow or slump into the well for the oil pump, otherwise the engine can be damaged due to insufficient lubrication. The present invention provides such V.I. improver-dispersants and oil compositions containing same.

SUMMARY OF THE INVENTION

The present invention is directed to multifunctional viscosity index improvers comprising the reaction products of (i) ethylene copolymers grafted with ethylenically unsaturated carboxylic acid moieties, (ii) polyamines or polyols, and (iii) a high functionality long chain hydrocarbyl substituted dicarboxylic acid material containing a polyolefin of from about 400 to about 10,000 number average molecular weight and having a functionality of from 1.2 to about 2. Oleaginous compositions containing these multifunctional viscosity index improvers, which also function as dispersants, exhibit improved low temperature viscometric properties.

DETAILED DESCRIPTION OF THE INVENTION

In accordance with the present invention there are provided oil soluble viscosity index improver-dispersant additives comprising the reaction products of (i) ethylene copolymers, such as copolymers of ethylene and propylene, grafted with ethylenically unsaturated carboxylic acid moieties, preferably maleic anhydride moieties; (ii) polyamines having two or more primary amine groups or polyols; and (iii) high functionality long chain hydrocarbyl substituted carboxylic acid material wherein the long chain hydrocarbyl is a polyolefin, preferably poly($C_4$ alkenyl), of from about 400 to about 10,000 number average molecular weight and having a functionality of from 1.2 to about 2.0. The V.I. improver-dispersants of the instant invention containing the high functionality long chain hydrocarbyl substituted dicarboxylic acid material when incorporated into oleaginous compositions such as lubricating oil compositions impart improved, i.e., decreased, low temperature viscosity characteristics relative to similar conventional V.I.-dispersants wherein the carboxylic acid component is a low functionality, e.g., about 0.5 to about 1.1, carboxylic acid component. That is to say by utilizing the high functionality long chain hydrocarbyl substituted dicarboxylic acid material in place of the conventional low functionality long chain hydrocarbyl substituted dicarboxylic acid or anhydride V.I.-dispersants exhibiting improved low temperature viscometric properties are provided.

ETHYLENE COPOLYMER

Oil soluble ethylene copolymers used in the invention generally will have a number average molecular weight ($\overline{M}_n$) of from above about 5000 to about 500,000; preferably 10,000 to 200,000 and optimally from about 20,000 to 100,000. In general, polymers useful as V.I. improvers will be used. These V.I. improvers will generally have a narrow range of molecular weight, as determined by the ratio of weight-average molecular weight ($\overline{M}_w$) to number-average molecular weight ($\overline{M}_n$). Polymers having a $\overline{M}_w/\overline{M}_n$ of less than 10, preferably less than 7, and more preferably 4 or less are most desirable. As used herein ($\overline{M}_n$) and ($\overline{M}_w$) are measured by the well known techniques of vapor phase osmometry (VPO), membrane osmometry and gel permeation chromatography. In general, polymers having a narrow range of molecular weight may be obtained by a choice of synthesis conditions such as choice of principal catalyst and cocatalyst combination, addition of hydrogen during the synthesis, etc. Post synthesis treatment such as extrusion at elevated temperature and under high shear through small orifices, mastication under elevated temperatures, thermal degradation, fractional precipitation from solution, etc. may also be used to obtain narrow ranges of desired molecular weights and to break down higher molecular weight polymer to different molecular weight grades for V.I. use.

These polymers are prepared from ethylene and ethylenically unsaturated hydrocarbons including cyclic, alicyclic and acyclic, containing from 3 to 28 carbons, e.g. 3 to 18 carbons. These ethylene copolymers may contain from 15 to 90 wt. % ethylene, preferably 30 to 80 wt. % of ethylene and 10 to 85 wt. %, preferably 20 to 70 wt. % of one or more $C_3$ to $C_{28}$, preferably $C_3$ to $C_{18}$ more preferably $C_3$ to $C_8$, alpha olefins. While not essential, such copolymers preferably have a degree of crystallinity of less than 25 wt. %, as determined by X-ray and differential scanning calorimetry. Copolymers of ethylene and propylene are most preferred. Other alpha-olefins suitable in place of propylene to form the copolymer, or to be used in combination with ethylene and propylene to form a terpolymer, tetrapolymer, etc., include 1-butene, 1-pentene, 1-hexene, 1-heptene, 1-octene, 1-nonene, 1-decene, etc.; also branched chain alpha-olefins, such as 4-methyl-1-pentene, 4-methyl-1-hexene, 4,4-dimethyl-1-pentene, and 6-methylheptene-1, etc., and mixtures thereof.

The term copolymer as used herein, unless otherwise indicated, includes terpolymers, tetrapolymers, etc., of ethylene, said $C_{3-28}$ alpha-olefin and/or a non-conjugated diolefin or mixtures of such diolefins which may also be used. The amount of the non-conjugated diolefin will generally range from about 0.5 to 20 mole percent, preferably about 1 to about 7 mole percent, based on the total amount of ethylene and alpha-olefin present.

Representative examples of non-conjugated dienes that may be used as the third monomer in the terpolymer include:

a. Straight chain acyclic dienes such as: 1,4-hexadiene; 1,5-heptadiene; 1,6-octadiene.
b. Branched chain acyclic dienes such as: 5-methyl-1,4-hexadiene; 3,7-dimethyl 1,6-octadiene; 3,7-dimethyl 1,7-octadiene; and the mixed isomers of dihydro-myrcene and dihydro-cymene.
c. Single ring alicyclic dienes such as: 1,4-cyclohexadiene; 1,5-cyclooctadiene; 1,5-cyclo-dodecadiene; 4-vinylcyclohexene; 1-allyl, 4-isopropylidene cyclohexane; 3-allyl-cyclopentene; 4-allyl cyclohexene and 1-isopropenyl-4-(4-butenyl) cyclohexane.
d. Multi-single ring alicyclic dienes such as: 4,4'-dicyclopentenyl and 4,4'-dicyclohexenyl dienes.
e. Multi-ring alicyclic fused and bridged ring dienes such as: tetrahydroindene; methyl tetrahydroindene; dicyclopentadiene; bicyclo (2.2.1)-hepta-2,5-diene; alkyl, alkenyl, alkylidene, cycloalkenyl and cycloalkylidene norbornenes such as: ethyl norbornene; 5-methylene-6-methyl-2-norbornene; 5-methylene-6,6-dimethyl-2-norbornene; 5-propenyl-2-norbornene; 5-(3-cyclopentenyl)-norbornene and 5-cyclohexylidene-2-norbornene; norbornadiene; etc.

ETHYLENICALLY UNSATURATED CARBOXYLIC ACID MATERIAL

These materials which are grafted (attached) onto the ethylene copolymer contain at least one ethylenic bond and at least one, preferably two, carboxylic acid groups, or an anhydride group, or a polar group which is convertible into said carboxyl groups by oxidation or hydrolysis. Preferred materials are (i) monounsaturated $C_4$ to $C_{10}$ dicarboxylic acids wherein (a) the carboxyl groups are vicinyl, i.e., located on adjacent carbon atoms, and (b) at least one, preferably both, of said adjacent carbon atoms are part of said monounsaturation; or (ii) derivatives of (i) such as anhydrides or $C_1$ to $C_5$alcohol derived mono- or diesters of (i). Upon raction with the ethylene copolymer, the monounsaturation of the dicarboxylic acid, anhydride, or ester becomes saturated. Thus, for example, maleic anhydride becomes a hydrocarbyl substituted succinic anhydride.

Maleic anhydride or a derivative thereof is preferred as it does not appear to homopolymerize appreciably but grafts onto the ethylene copolymer to give two carboxylic acid functionalities. Such preferred materials have the generic formula

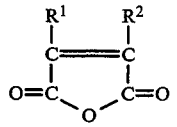

wherein $R^1$ and $R^2$ are hydrogen. Suitable examples additionally include chloro-maleic anhydride, itaconic anhydride, or the corresponding dicarboxylic acids, such as maleic acid or fumaric acid or their monoesters, etc.

As taught by U.S. Pat. No. 4,160,739 and U.S. Pat. No. 4,161,452, both of which are incorporated herein by reference, various unsaturated comonomers may be grafted on the olefin copolymer together with the unsaturated acid component, e.g. maleic anhydride. Such graft monomer systems may comprise one or a mixture of comonomers different from the unsaturated acid component and which contain only one copolymerizable double bond and are copolymerizable with said unsaturated acid component. Typically, such comonomers do not contain free carboxylic acid groups and are esters containing alpha, beta-ethylenic unsaturation in the acid or alcohol portion; hydrocarbons, both aliphatic and aromatic, containing alpha, beta-ethylenic unsaturation, such as the $C_4$–$C_{12}$ alpha olefins, for example isobutylene, hexene, nonene, dodecene, etc.; styrenes, for example styrene, alpha-methyl styrene, p-methyl styrene, p-sec. butyl styrene, etc.; and vinyl monomers, for example vinyl acetate, vinyl chloride, vinyl ketones such as methyl and ethyl vinyl ketone, etc. Comonomers containing functional groups which may cause crosslinking, gelation or other interfering reactions should be avoided, although minor amounts of such comonomers (up to about 10% by weight of the comonomer system) often can be tolerated.

Specific useful copolymerizable comonomers include the following:

(A) Esters of saturated acids and unsaturated alcohols wherein the saturated acids may be monobasic or polybasic acids containing up to about 40 carbon atoms such as the following: acetic, propionic, butyric, valeric, caproic, stearic, oxalic, malonic, succinic, glutaric, adipic, pimelic, suberic, azelaic, sebacic, phthalic, isophthalic, terephthalic, hemimellitic, trimellitic, trimesic and the like, including mixtures. The unsaturated alcohols may be monohydroxy or polyhydroxy alcohols and may contain up to about 40 carbon atoms, such as the following: allyl, methallyl, crotyl, 1-chloroallyl, 2-chloroallyl, cinnamyl, vinyl, methyl vinyl, 1-phenallyl, butenyl, propargyl, 1-cyclohexene-3-ol, oleyl, and the like, including mixtures.

(B) Esters of unsaturated monocarboxylic acids containing up to about 12 carbon atoms such as acrylic, methacrylic and crotonic acid, and an esterifying agent containing up to about 50 carbon atoms, selected from saturated alcohols and alcohol epoxides. The saturated alcohols may preferably contain up to about 40 carbon atoms and include monohydroxy compounds such as: methanol, ethanol, propanol, butanol, 2-ethylhexanol, octanol, dodecanol, cyclohexanol, cyclopentanol, neopentyl alcohol, and benzyl alcohol; and alcohol ethers such as the monomethyl or monobutyl ethers of ethylene or propylene glycol, and the like, including mixtures. The alcohol epoxides include fatty alcohol epoxides, glycidol, and various derivatives of alkylene oxides, epichlorohydrin, and the like, including mixtures.

The components of the graft copolymerizable system are used in a ratio of unsaturated acid monomer component to comonomer component of about 1:4 to 4:1, preferably about 1.2 to 2:1 by weight.

GRAFTING OF THE ETHYLENE COPOLYMER

The grafting of the ethylene copolymer with the ethylenically unsaturated carboxylic acid material may be by any suitable method, such as thermally by the "ene" reaction, using copolymers containing unsaturation, such as ethylene-propylene-diene polymers either chlorinated or unchlorinated, extruder or masticator grafting, or more preferably it is by free-radical induced grafting in solvent, preferably in a mineral lubricating oil as solvent.

The free-radical induced grafting of ethylenically unsaturated carboxylic acid materials in solvents, such as benzene, is known in the art and disclosed, inter alia, in U.S. Pat. No. 2,236,917, incorporated herein by reference. The free-radical grafting is preferably carried out using free radical initiators such as peroxides and hydroperoxides, and nitrile compounds, preferably those which have a boiling point greater than about 100° C. and which decompose thermally within the grafting temperature range to provide said free radicals. Representative of these free-radical initiators are azobutyronitrile, 2,5-dimethyl-hex-3-yne-2, 5 bis-tertiary-butyl peroxide (sold as Luperso 130) or its hexane analogue, di-tertiary butyl peroxide and dicumyl peroxide. The initiator is generally used at a level of between about 0.005% and about 1%, based on the total weight of the polymer solution, and temperatures of about 150° to 220° C.

The ethylenically unsaturated carboxylic acid material, preferably maleic anhydride, will be generally used in an amount ranging from about 0.01% to about 10%, preferably 0.1 to 2.0%, based on weight of the initial total solution. The aforesaid carboxylic acid material and free radical initiator are generally used in a weight percent ratio of ethylenically unsaturated carboxylic acid material to free radical initiator of about 1.0:1 to 30:1, preferably 3.0:1 to 6:1.

The initiator grafting is preferably carried out in an inert atmosphere, such as that obtained by nitrogen blanketing. While the grafting can be carried out in the presence of air, the yield of the desired graft polymer is generally thereby decreased as compared to grafting under an inert atmosphere substantially free of oxygen. The grafting time will usually range from about 0.1 to 12 hours, preferably from about 0.5 to 6 hours, more preferably 0.5 to 3 hours. The graft reaction will be usually carried out to at least approximately 4 times, preferably at least about 6 times the half-life of the free-radical initiator at the reaction temperature employed, e.g. with 2,5-dimethyl hex-3-yne-2, 5-bis(t-butyl peroxide) 2 hours at 160° C. and one hour at 170° C., etc.

In the grafting process, usually the copolymer solution is first heated to grafting temperature and thereafter said unsaturated carboxylic acid material and initiator are added with agitation, although they could have been added prior to heating. When the reaction is complete, the excess acid material can be eliminated by an inert gas purge, e.g. nitrogen sparging. Preferably the carboxylic acid material that is added is kept below its solubility limit in the polymer solution, e.g. below about 1 wt. %, preferably below 0.4 wt. % or less, of free maleic anhydride based on the total weight of polymer-solvent solution, e.g. ethylene copolymer mineral lubricating oil solution. Continuous or periodic addition of the carboxylic acid material along with an appropriate portion of initiator, during the course of the reaction, can be utilized to maintain the carboxylic acid below its solubility limits, while still obtaining the desired degree of total grafting.

In the grafting step the maleic anhydride or other carboxylic acid material used may be grafted onto both the polymer and the solvent for the reaction. Many solvents such as dichlorobenzene are relatively inert and may be only slightly grafted, while mineral oil will tend to be more grafted. The exact split of graft between the substrates present depends upon the polymer and its reactivity, the reactivity and type of solvent, the concentration of the polymer in the solvent, and also upon the maintenance of the carboxylic acid material in solution during the course of the reaction and minimizing the presence of dispersed, but undissolved acid, e.g. the maleic anhydride. The undissolved acid material appears to have an increased tendency to react to form oil insoluble materials as opposed to dissolved acid material. The split between grafted solvent and grafted polymer may be measured empirically from the infrared analyses of the product dialyzed into solvent and polymer fractions.

The grafting is preferably carried out in a mineral lubricating oil which need not be removed after the grafting step but can be used as the solvent in the subsequent reaction of the graft polymer with the amine material and as a solvent for the end product to form the lubricating additive concentrate. The oil having attached, grafted carboxyl groups, when reacted with the amine material will also be converted to the corresponding derivatives.

The solution grafting step when carried out in the presence of a high temperature decomposable peroxide can be accomplished without substantial degradation of the chain length (molecular weight) of the ethylene containing polymer.

THE POLYAMINES

The amine component which may be reacted with the grafted ethylene copolymer will have two or more primary amine groups, wherein the primary amine groups may be unreacted, or wherein one of the amine groups may already be reacted.

Preferred amines are aliphatic saturated amines, including those of the general formulae:

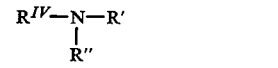

(I)

and

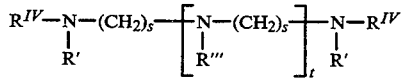

(Ia)

wherein $R^{IV}$, R', R'' and R''' are independently selected from the group consisting of hydrogen; $C_1$ to $C_{25}$ straight or branched chain alkyl radicals; $C_1$ to $C_{12}$ alkoxy $C_2$ to $C_6$ alkylene radicals; $C_2$ to $C_{12}$ hydroxy amino alkylene radicals; and $C_1$ to $C_{12}$ alkylamino $C_2$ to $C_6$ alkylene radicals; and wherein R'' and R''' can additionally comprise a moiety of the formula

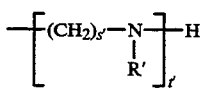

(Ib)

wherein R' is as defined above, and wherein each s and s' can be the same or a different number of from 2 to 6, preferably 2 to 4; and t and t' can be the same or different and are each numbers of typically from 0 to 10, preferably about 2 to 7, most preferably about 3 to 7, with the proviso that t+t' is not greater than 10. To assure a facile reaction it is preferred that $R^{IV}$, R', R'', R''', (s), (s'), (t) and (t') be selected in a manner sufficient to provide the compounds of formula Ia with typically at least two primary amino groups. This can be achieved by selecting at least one of said $R^{IV}$, R'', or R''' groups to be hydrogen or by letting (t) in formula Ia be at least one when R''' is H or when the (Ib) moiety possesses a primary a amino group.

Non-limiting examples of suitable amine compounds include: 1,2-diaminoethane; 1,3-diaminopropane; 1,4-diaminobutane; 1,6-diaminohexane; polyethylene amines such as diethylene triamine; triethylene tetramine; tetraethylene pentamine; polypropylene amines such as 1,2-propylene diamine; di-(1,2-propylene) triamine; di-(1,3-propylene) triamine; N,N-dimethyl-1, 3-diaminopropane; N,N-di-(2-aminoethyl) ethylene diamine; N,N-di(2-hydroxyethyl)-1,3-propylene diamine; N-dodecyl-1,3propane diamine; and mixtures thereof.

Other useful amine compounds include: alicyclic diamines such as 1,4-di(aminoethyl) cyclohexane, and N-aminoalkyl piperazines of the general formula:

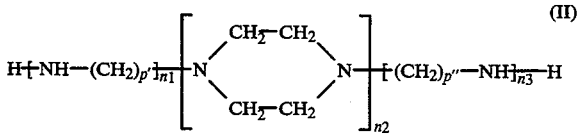

(II)

wherein $p_1$ and $p_2$ are the same or different and are each integers of from 1 to 4, and $n_1$, $n_2$ and $n_3$ are the same or different and are each integers of from 1 to 3.

Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and corresponding piperazines. Low cost poly(ethyleneamine) compounds averaging about 5 to 7 nitrogen atoms per molecule are available commercially under trade names such as "Polyamine H", "Polyamine 400", "Dow Polyamine E-100", etc.

Useful amines also include polyoxyalkylene polyamines such as those of the formulae:

$$NH_2\text{—alkylene}(\text{O—alkylene})_m\text{—}NH_2 \quad \text{(III)}$$

where m has a value of about 3 to 70 and preferably 10 to 35; and $$R^V(\text{alkylene}(\text{O—alkylene})_n\text{—}NH_2)_a \quad \text{(IV)}$$

where n has a value of about 1 to 40, with the provision that the sum of all the n's is from about 3 to about 70, and preferably from about 6 to about 35, and $R^V$ is a substituted saturated hydrocarbon radical of up to 10 carbon atoms, wherein the number of substituents on the $R^V$ group is from 3 to 6, and "a" is a number from 3 to 6 which represents the number of substituents on $R^V$. The alkylene groups in either formula (III) or (IV) may be straight or branched chains containing about 2 to 7, and preferably about 2 to 4 carbon atoms.

Particularly preferred polyamine compounds are the polyoxyalkylene polyamines of Formulae III and IV, and the alkylene polyamines represented by the formula

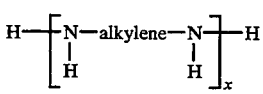

(V)

wherein x is an integer of about 1 to 10, preferably about 2 to 7, and the alkylene radical is a straight or branched chain alkylene radical having 2 to 7, preferably about 2 to 4 carbon atoms.

Examples of the alkylene polyamines of formula (V) include methylene amines, ethylene amines, butylene amines, propylene amines, pentylene amines, hexylene amines, heptylene amines, octylene amines, other polymethylene amines, the cyclic and higher homologs of these amines such as the piperazines, the amino-alkyl-substituted piperazines, etc. These amines include, for example, ethylene diamine, diethylene triamine, triethylene tetramine, propylene diamine, di(-heptamethylene)triamine, tripropylene tetramine, tetraethylene pentamine, trimethylene diamine, pentaethylene hexamine, di(trimethylene)triamine, 2-heptyl-3-(2-aminopropyl)imidazoline, 4-methylimidazoline, 1,3-bis-(2-aminopropyl)imidazoline, pyrimidine, 1-(2-aminopropyl)piperazine, 1,4-bis(2-aminoethyl)piperazene, N,N'-dimethyaminopropyl amine, N,N'-dioctylethyl amine, N-octyl-N'-methylethylene diamine, 2-methyl-1-(2aminobutyl)piperazine, etc. Other higher homologs which may be used can be obtained by condensing two or more of the above-mentioned alkylene amines in a known manner.

The ethylene amines which are particularly useful are described, for example, in the Encyclopedia of Chemical Technology under the heading of "Ethylene Amines" (Kirk and Othmer), Volume 5, pgs. 898–905; Interscience Publishers, New York (1950), incorporated herein by reference. These compounds are prepared by the reaction of an alkylene chloride with ammonia. This results in the production of a complex mixture of alkylene amines, including cyclic condensation products such as piperazines. While mixtures of these amines may be used for purposes of this invention, it is obvious that pure alkylene amines may be used with complete satisfaction.

The polyoxyalkylene polyamines of formulae III and IV, preferably polyoxyalkylene diamines and polyoxyalkylene triamines, may have average molecular weights ranging from about 200 to about 4000 and preferably from about 400 to about 2000. The preferred polyoxyalkylene polyamines include the polyoxyethylene and the polyoxypropylene diamines and the polyoxypropylene triamines having average molecular weights ranging from about 200 to 2000. The polyoxyalkylene polyamines are commercially available and may be obtained, for example, from the Jefferson Chemical Company, Inc. under the trade name "Jeffamines D-230, D-400, D-1000, D-2000, T-403", etc.

POLYOL

In another aspect of the invention the grafted ethylene copolymer is reacted with a polyol instead of with a polyamine.

Suitable polyol compounds which can be used include aliphatic polyhydric alcohols containing up to about 100 carbon atoms and about 2 to about 10 hydroxyl groups. These alcohols can be quite diverse in structure and chemical composition, for example, they can be substituted or unsubstituted, hindered or unhindered, branched chain or straight chain, etc. as desired. Typical alcohols are alkylene glycols such as ethylene glycol, propylene glycol, trimethylene glycol, butylene glycol, and polyglycols such as diethylene glycol, triethylene glycol, tetraethylene glycol, dipropylene glycol, tripropylene glycol, dibutylene glycol, tributylene glycol, and other alkylene glycols and polyalkylene glycols in which the alkylene radical contains from two to about eight carbon atoms. Other useful polyhydric alcohols include glycerol, monomethyl ether of glycerol, pentaerythritol, dipentaerythritol, tripentaerythritol, 9,10-dihydroxystearic acid, the ethyl ester of 9,10-dihydroxystearic acid, 3-chloro-1,2-propanediol, 1,2-butanediol, 1,4-butanediol, 2,3-hexanediol, pinacol, tetrahydroxy pentane, erythritol, arabitol, sorbitol, mannitol, 1,2-cyclohexanediol, 1,4-cyclohexanediol, 1,4-(2-hydroxyethyl)-cyclohexane, 1,4-dihydroxy-2-nitrobutane, 1,4-di-(2-hydroxyethyl)-benzene, and the carbohydrates such as glucose, mannose, glyceraldehyde, galactose, and the like.

Included within the group of aliphatic alcohols are those alkane polyols which contain ether groups such as polyethylene oxide repeating units, as well as those polyhydric alcohols containing at least three hydroxyl groups, at least one of which has been esterified with a mono-carboxylic acid having from eight to about 30 carbon atoms such as octanoic acid, oleic acid, stearic acid, linoleic acid, dodecanoic acid, or tall oil acid. Examples of such partially esterified polyhydric alcohols are the mono-oleate of sorbitol, the mono-oleate of glycerol, the monostearate of glycerol, the di-stearate of sorbitol, and the di-dodecanoate of erythritol.

A preferred class of aliphatic alcohols are those containing up to 20 carbon atoms, and especially those containing three to 15 carbon atoms. This class of alcohols includes glycerol, erythritol, pentaerythritol, dipentaerythritol, tripentaerythritol, gluconic acid, glyceraldehyde, glucose, arabinose, 1,7-heptanediol, 2,4-heptanediol, 1,2,3-hexanetriol, 1,2,4-hexanetriol, 1,2,5-hexanetriol, 2,3,4-hexanetriol, 1,2,3-butanetriol, 1,2,4-butanetriol, 2,2,6,6-tetrakis(hydroxymethyl)cyclohexanol, 1,10-decanediol, and the like.

An especially preferred class of polyhydric alcohols are the polyhydric alkanols containing three to 15, especially three to six carbon atoms and having at least three hydroxyl groups. Such alcohols are exemplified in the above specifically identified alcohols and are represented by glycerol, erythritol, pentaerythritol, mannitol, sorbitol, 1,2,4-hexanetriol, and tetrahydroxy pentane and the like.

THE HIGH FUNCTIONALITY DICARBOXYLIC ACID MATERIAL

The high functionality long chain hydrocarbyl substituted dicarboxylic acid material which is used to make the multifunctional viscosity index improver of the instant invention includes the reaction product of long chain hydrocarbon polymer, generally a polyolefin, with (i) monounsaturated $C_4$ to $C_{10}$ dicarboxylic acid wherein (a) the carboxyl groups are vicinyl, i.e., located on adjacent carbon atoms, and (b) at least one, preferably both, of said adjacent carbon atoms are part of said mono unsaturation; or with (ii) derivatives of (i) such as anhydrides or $C_1$ to $C_5$ alcohol derived mono- or diesters of (i). Upon reaction with the hydrocarbon polymer, the monounsaturation of the dicarboxylic acid, anhydride, or ester becomes saturated. Thus, for example, maleic anhydride becomes a hydrocarbyl substituted succinic anhydride.

Typically, from about 1.7 to about 2.8, preferably from about 1.8 to about 2.7, and more preferably from about 1.9 to about 2.6 moles of said unsaturated $C_4$ to $C_{10}$ dicarboxylic acid, anhydride or ester are charged to the reactor per mole of polyolefin charged.

Normally, not all of the polyolefin reacts with the unsaturated acid or derivative and the hydrocarbyl substituted dicarboxylic acid material will contain unreacted polyolefin. The unreacted polyolefin is typically not removed from the reaction mixture (because such removal is difficult and would be commercially infeasible) and the product mixture, stripped of any unreacted monounsaturated $C_4$ to $C_{10}$ dicarboxylic acid, anhydride, or ester is employed for further reaction with the amine or alcohol as described hereinafter to make the dispersant.

Characterization of the average number of moles of dicarboxylic acid, anhydride, or ester, which have reacted per mole of polyolefin charged to the reaction (whether it has undergone reaction or not) is defined herein as functionality. Said functionality is based upon (i) determination of the saponification number of the resulting product mixture using potassium hydroxide; and (ii) the number average molecular weight of the polymer charged, using techniques well known in the art. Functionality is defined solely with reference to the resulting product mixture. Although the amount of said reacted polyolefin contained in the resulting product mixture can be subsequently modified, i.e. increased or decreased by techniques known in the art, such modifications do not alter functionality as defined above. The term hydrocarbyl substituted dicarboxylic acid material is intended to refer to the product mixture whether it has undergone such modification of not.

Accordingly, the functionality of the high functionality long chain hydrocarbyl substituted dicarboxylic acid material is at least 1.2, preferably at least about 1.3, more preferably at least about 1.4, and is generally from 1.2 to about 2.0, preferably from about 1.3 to about 1.9, and more preferably from about 1.4 to about 1.8.

Exemplary of such unsaturated mono and dicarboxylic acids, or anhydrides and esters thereof are fumaric acid, itaconic acid, maleic acid, maleic anhydride, chloromaleic acid, chloromaleic anhydride, acrylic acid, methacrylic acid, crotonic acid, cinnamic acid, etc.

Preferred olefin polymers for reaction with the unsaturated dicarboxylic acid, or anhydride are polymers comprising a major molar amount of $C_2$ to $C_{28}$, e.g. $C_2$to $C_5$, monoolefin. Such olefins include ethylene, propylene, butene, isobutylene, pentene, octene-1, styrene, etc. The polymers can be homopolymers such as polybutene, as well as copolymers of two or more of such olefins such as copolymers of: ethylene and propylene; butylene and isobutylene; propylene and isobutylene; etc. Other copolymers include those in which a minor molar amount of the copolymer monomers, e.g., 1 to 10 mole %, is a $C_4$ to $C_{18}$ non-conjugated diolefin, e.g., a copolymer of isobutylene and butadiene; or a copolymer of ethylene, propylene and 1,4-hexadiene; etc.

In some cases the olefin polymer may be completely saturated, for example an ethylene-propylene copolymer made by a Ziegler-Natta synthesis using hydrogen as a moderator to control molecular weight.

The olefin polymers will usually have number average molecular weights ($\overline{M}_n$) within the range of about 400 and about 10,000, preferably between about 400 to 5000, and more preferably between about 600 and about 2500. Particularly useful olefin polymers have number average molecular weights within the range of about 800 and about 1100 with approximately one terminal double bond per polymer chain. An especially useful starting material for the high functionality long chain hydrocarbyl substituted dicarboxylic acid producing material of this invention is poly(butene) or poly($C_4$-alkene), e.g., poly(n-butene), polyisobutylene, and mixtures thereof.

Processes for reacting the olefin polymer with the $C_4$–$C_{10}$ unsaturated dicarboxylic acid, anhydride or ester are known in the art. For example, the olefin polymer and the dicarboxylic acid material may be simply heated together as disclosed in U.S. Pat. Nos. 3,361,673 and 3,401,118 to cause a thermal "ene" reaction to take place. Alternatively, the olefin polymer can be first halogenated, for example, chlorinated or brominated to about 1 to 8, preferably 3 to 7 wt. % chlorine or bromine, based on the weight of polymer, by passing the chlorine or bromine through the polyolefin at a temperature of 60° to 160° C., e.g., 110° to 130° C., for about 0.5 to 10, preferably 1 to 7 hours. The halogenated polymer may then be reacted with sufficient unsaturated acid or anhydride at 100° to 250° C., usually about 180° to 235° C., for about 0.5 to 10 hours, e.g. 3 to 8 hours. Processes of this general type are taught, inter alia, in U.S. Pat. Nos. 3,087,436; 3,172,892; 3,272,746; and U.S. patent application Ser. No. 919,395, filed Oct. 16, 1986 now abandoned, all of which are incorporated herein by reference.

Alternatively, the olefin polymer and the unsaturated acid material are mixed and heated while adding chlorine to the hot material. Processes of this type are disclosed in U.S. Pat. Nos. 3,215,707; 3,231,587; 3,912,764; 4,110,349; 4,234,435; and in U.K. 1,440,219.

By the use of halogen, about 65 to 95 wt. % of the polyolefin, e.g. poly(butene), will normally react with the dicarboxylic acid material. Upon carrying out a thermal reaction without the use of halogen or a catalyst, then usually only about 50 to 85 wt. % of the polyisobutylene will react. Chlorination helps increase the reactivity.

The preferred high functionality long chain hydrocarbyl substituted dicarboxylic acid material is polyisobutenyl succinic anhydride having a functionality of from 1.2 to about 2.0, preferably from about 1.3 to about 1.9, and more preferably from about 1.4 to about 1.8.

REACTION OF GRAFTED ETHYLENE COPOLYMERS WITH AMINE OR POLYOL AND HIGH FUNCTIONALITY LONG CHAIN HYDROCARBYL SUBSTITUTED DICARBOXYLIC ACID MATERIAL

The grafted ethylene copolymer, preferably in solution generally equal to about 5 to 30 wt. %, preferably 10 to 20 wt. % polymer, can be readily reacted with a mixture of amine or polyol and high functionality long chain hydrocarbyl substituted dicarboxylic acid material by heating said mixture at a temperature of from about 100° C. to 250° C., preferably from 150° to 200° C., for from 0.1 to 10 hours, usually about 0.5 to about 3 hours. The heating is preferably carried out to favor, in the case of polyamines, formation of imides rather than amides and salts. Thus, imide formation will give a lower viscosity of the reaction mixture than amide formation and particularly lower than salt formation. This lower viscosity permits the utilization of a higher concentration of grafted ethylene copolymer in the reaction mixture. Removal of water, e.g., by $N_2$ stripping during slow addition of the amine with stirring assures completion of the imidation reaction. Reaction ratios can vary considerably, depending upon the reactants, amounts of excess, type of bonds formed, etc. The amount of polyamine or polyol used is an amount effective to enhance or improve the dispersant properties of the compounds of the instant invention. Generally, in the case of the polyamines, the amount of polyamine used is an amount which is effective to provide from about 0.5 to about 1.5 equivalents, preferably from about 0.8 to about 1.2 equivalents, and more preferably from about 0.9 to about 1.0 equivalents of primary amine per equivalent of acid of the grafted dicarboxylic acid moiety e.g., succinic anhydride.

The amount of high functionality long chain hydrocarbyl substituted dicarboxylic acid material utilized is an amount which is (i) effective to prevent cross-linking or excessive chain-extenion of the grafted ethylene copolymer during amination/imidation thereof, and (ii) effective to provide a V.I. improver-dispersant composition exhibiting improved low temperature viscometric properties in oil relative to a V.I. improver-dispersant composition prepared using a conventional low functionality long chain hydrocarbyl substituted dicarboxylic acid material. Generally this amount is from about 0.3 to about 1.2, preferably from about 0.6 to about 1.2, more preferably from about 0.9 to about 1.1 mole equivalents of said high functionality long chain hydrocarbyl substituted dicarboxylic acid material per mole of the grafted dicarboxylic acid moiety content, e.g., grafted maleic anhydride content, of the grafted ethylene copolymer and solvent, if any, such as oil.

The long chain hydrocarbyl substituted dicarboxylic acid material of the present invention has a higher functionality than the long chain hydrocarbyl substituted dicarboxylic acid material of conventional V.I.-dispersants. Thus, the high functionality long chain hydrocarbyl substituted dicarboxylic acid material contains more reacted dicarboxylic acid moieties than an equal weight amount of a low functionality hydrocarbyl substituted dicarboxylic acid material. Therefore, it requires a smaller weight amount of the high functionality long chain hydrocarbyl substituted dicarboxylic acid material to provide a number of dicarboxylic acid moieties equivalent to the number of said dicarboxylic acid moieties present in a larger amount of low functionality long chain hydrocarbyl substituted dicarboxylic acid material. As discussed hereinafore it is the dicarboxylic acid moieties of the long chain hydrocarbyl substituted dicarboxylic acid material that react, in the case of polyamines, with the remaining unreacted primary amino groups of the polyamine (the other primary amino group of the polyamine having reacted with the acid moiety of the acid grafted ethylene copolymer) to reduce or inhibit cross-linking or excessive chain-extension between the grafted ethylene copolymer molecules. As further discussed hereinafore it is also these dicarboxylic acid moieties that react with the oil molecules (which were grafted with maleic anhydride during the ethylene copolymer grafting and reacted with the amine) to solubilize these grafted oil molecules. Therefore, less weight amount of the high functionality long chain hydrocarbyl substituted dicarboxylic acid material than of a low functionality long chain hydrocarbyl substituted dicarboxylic acid material is required to achieve these beneficial effects of limiting cross-linking and solubilization.

While not wishing to be bound by any theory, it is believed that it is the presence of the relatively low molecular weight long chain hydrocarbyl substituted dicarboxylic acid material (relative to the high molecular weight ethylene copolymer) that is at least partially responsible for the debit in the low temperature viscosity of the V.I.-dispersant. Reducing the amount of this long chain hydrocarbyl substituted dicarboxylic acid material results in a credit to the low temperature viscosity of the V.I.-dispersant. However, if said long chain hydrocarbyl substituted dicarboxylic acid material is of low functionality, decreasing the amount of this acid material would adversely affect its beneficial effects of inhibiting cross-linking or excessive chain-extension of the grafted ethylene copolymer molecules during amination/imidation and solubilizing grafted oil molecules. Since the long chain hydrocarbyl substituted dicarboxylic acid material of the present invention is a high functionality long chain hydrocarbyl substituted dicarboxylic acid material a smaller amount of this high functionality acid material provides a number of reacted dicarboxylic acid or anhydride moieties equal to that present in a larger amount of low functionality long chain hydrocarbyl substituted dicarboxylic acid material and, therefore, smaller amounts of the high functionality long chain hydrocarbyl substituted dicarboxylic acid material can be used without substantially deleteriously affecting the intended function of said acid material, i.e., inhibiting cross-linking or excessive chain-extension of the grafted ethylene copolymer during amination/imidation and solubilizing the grafted oil molecules. Reducing the amount of the long chain hydrocarbyl substituted dicarboxylic acid material, which reduction is made possible by the utilization of the high functionality long chain hydrocarbyl substituted dicarboxylic acid material of the instant invention, results in an improvement in the low temperature viscometric properties of the V.I.-dispersant.

Alternatively, the polyamine or polyol and the high functionality long-chain hydrocarbyl substituted dicarboxylic acid material may be pre-reacted to form an amine-acid adduct or ester adduct, and this adduct may then be reacted with the grafted ethylene copolymer. In the case of the amine-acid adduct the acid moiety of the high functionality long chain hydrocarbyl substituted dicarboxylic acid material is generally attached to the polyamine moiety through salt, imide, amide, amidine, ester or other linkages formed with one primary amine group of said polyamine so that another primary amine group of the polyamine is still available for reaction with the acid moieties of the grafted ethylene copolymer. In the case of the ester adduct the acid moiety is generally attached to the polyol moiety through ester linkages formed with one hydroxy group of the polyol so that another hydroxyl group of the polyol is still available for reaction with the acid moieties of the grafted ethylene copolymer.

Usually, these adducts are made by condensing the high functionality long chain hydrocarbyl substituted dicarboxylic material, preferably a succinic acid producing material such as alkenyl succinic anhydride, with a polyamine or polyol including those described above under "The Amines" or "The Polyols".

Formation of dicarboxylic acid polyamine or polyol adduct by reaction of polyamine or polyol with alkenyl succinic anhydride prepared from the reaction of a polyolefin or chlorinated polyolefin and maleic anhydride, etc. is well known in the art, as seen in U.S. Pat. No. 3,272,746.

Most preferred are the adducts made by reaction of the aforesaid alkylene polyamines, previously described, with a high functionality alkenyl succinic anhydride.

Reaction, in the case of a polyamine, preferably amination and/or imidation of the high functionality long chain hydrocarbyl substituted dicarboxylic acid material is usefully done as a solution reaction with said dicarboxylic acid material, usually polyisobutenylsuccinic anhydride, dissolved in a solvent such as mineral oil, to which the other reactant is added. The formation of the adducts in high yield can be effected by adding from about 0.5 to 3.3 preferably about 0.7 to 1.3, most preferably about 1 molar proportion of the alkylene polyamine per molar proportion of alkenyl succinic anhydride to said solution and heating the mixture at 140° C. to 165° C. or higher until the appropriate amount of water of reaction is evolved. Typically the mineral oil solvent is adjusted so that it constitutes 50% by weight of the final acyl nitrogen compound solution.

Another, and generally preferred, method of making the multi-functional viscosity index improvers of the instant invention is a sequential reaction process comprising (i) forming the grafted ethylene copolymer, (ii) adding to said grafted ethylene copolymer the high functionality long chain hydrocarbyl substituted dicarboxylic acid material so as to form a mixture of said grafted ethylene copolymer and said high functionality long chain hydrocarbyl substituted dicarboxylic acid material, and (iii) reacting this mixture with the polyamine or polyol.

A minor amount, e.g. 0.001 up to 50 wt. %, preferably 0.005 to 25 wt. %, based on the weight of the total composition, of the oil-soluble functionalized graft ethylene copolymers produced in accordance with this invention can be incorporated into a major amount of an oleaginous material, such as lubricating oil or hydrocarbon fuel, depending upon whether one is forming finished products or additives concentrates. When used in lubricating oil compositions, e.g. automotive or diesel crankcase lubricating oil, the nitrogen-containing or ester-containing grafted polymer concentrations are usually within the range of about 0.01 to 10 wt. %, e.g. 0.1 to 6.0 wt. %, preferably 0.25 to 3.0 wt. %, of the total composition. The lubricating oils to which the products of this invention can be added include not only hydrocarbon oil derived from petroleum, but also include synthetic lubricating oils such as esters of dibasic acids; complex esters made by esterification of monobasic acids, polyglycols, dibasic acids and alcohols; polyolefin oils, etc.

The multi-functional viscosity index improvers of the instant invention may be utilized in a concentrate form, e.g., from about 5 wt. % up to about 50 wt. %, preferably 7 to 25 wt. %, in oil, e.g., mineral lubricating oil, for ease of handling, and may be prepared in this form by carrying out the reaction of the invention in oil as previously discussed.

The compositions produced in accordance with the present invention have been found to be particularly useful as fuel and lubricating oil additives.

When the compositions of this invention are used in normally liquid petroleum fuels, such as middle distillates boiling from about 65° to 430° F. including kerosene, diesel fuels, home heating fuel oil, jet fuels, etc., a concentration of the additive in the fuel in the range of typically from 0.001 wt. % to 0.5 wt. %, preferably 0.005 wt. % to 0.2 wt. %, based on the total weight of the composition, will usually be employed. These additives can contribute fuel stability as well as dispersant activity and/or varnish control behavior to the fuel.

The compounds of this invention find their primary utility, however, in lubricating oil compositions, which employ a base oil in which the additives are dissolved or dispersed. Such base oils may be natural or synthetic.

Thus, base oils suitable for use in preparing the lubricating compositions of the present invention include those conventionally employed as crankcase lubricating oils for spark-ignited and compression-ignited internal combustion engines, such as automobile and truck engines, marine and railroad diesel engines, and the like. Advantageous results are also achieved by employing the additives of the present invention in base oils conventionally employed in and/or adapted for use as power transmitting fluids such as automatic transmission fluids, tractor fluids, universal tractor fluids and hydraulic fluids, heavy duty hydraulic fluids, power steering fluids and the like. Gear lubricants, industrial oils, pump oils and other lubricating oil compositions can also benefit from the incorporation therein of the additives of the present invention.

Thus, the additives of the present invention may be suitably incorporated into synthetic base oils such as alkyl esters of dicarboxylic acids, polyglycols and alcohols; polyalpha-olefins, polybutenes, alkyl benzenes, organic esters of phosphoric acids, polysilicone oils, etc. selected type of lubricating oil composition can be included as desired.

The additives of this invention are oil-soluble, dissolvable in oil with the aid of a suitable solvent, or are stably dispersible materials. Oil-soluble, dissolvable, or stably dispersible as that terminology is used herein does not necessarily indicate that the materials are soluble, dissolvable, miscible, or capable of being suspended in oil in all proportions. It does mean, however, that the additives, for instance, are soluble or stably dispersible in oil to an extent sufficient to exert their intended effect in the environment in which the oil is employed. Moreover, the additional incorporation of other additives may also permit incorporation of higher levels of a particular polymer adduct hereof, if desired.

Accordingly, while any effective amount of these additives can be incorporated into the fully formulated lubricating oil composition, it is contemplated that such effective amount be sufficient to provide said lube oil composition with an amount of the additive of typically from 0.01 to about 10, e.g., 0.1 to 6.0, and preferably from 0.25 to 3.0 wt. %, based on the weight of said composition.

The additives of the present invention can be incorporated into the lubricating oil in any convenient way. Thus, they can be added directly to the oil by dispersing, or dissolving the same in the oil at the desired level of concentration, typically with the aid of a suitable solvent such as toluene, cyclohexane, or tetrahydrofuran. Such blending can occur at room temperature or elevated.

Natural base oils include mineral lubricating oils which may vary widely as to their crude source, e.g., whether paraffinic, naphthenic, mixed, paraffinicnaphthenic, and the like; as well as to their formation, e.g., distillation range, straight run or cracked, hydrofined, solvent extracted and the like.

More specifically, the natural lubricating oil base stocks which can be used in the compositions of this invention may be straight mineral lubricating oil or distillates derived from paraffinic, naphthenic, asphaltic, or mixed base crudes, or, if desired, various blends oils may be employed as well as residuals, particularly those from which asphaltic constituents have been removed. The oils may be refined by conventional methods using acid, alkali, and/or clay or other agents such as aluminum chloride, or they may be extracted oils produced, for example, by solvent extraction with solvents of the type of phenol, sulfur dioxide, furrural, dichlorodiethyl ether, nitrobenzene, crotonaldehyde, etc.

The lubricating oil base stock conveniently has a viscosity of typically about 2.5 to about 12, and preferably about 2.5 to about 9 cSt. at 100° C.

Thus, the additives of the present invention can be employed in a lubricating oil composition which comprises lubricating oil, typically in a major amount, and the additive, typically in a minor amount, which is effective to impart enhanced dispersancy relative to the absence of the additive. Additional conventional additives selected to meet the particular requirements of a temperatures. In this form the additive per se is thus being utilized as a 100% active ingredient form which can 1 added to the oil or fuel formulation by the purchaser. Alternatively, these additives may be blended with suitable oil-soluble solvent and base oil to form concentrate, which may then be blended with a lubricating oil base stock to obtain the final formulation. Concentrates will typically contain from about 2 to 80 wt. %, by weight of the additive, and preferably from about 5 to 40% by weight of the additive.

The lubricating oil base stock for the additive of the present invention typically is adapted to perform selected function by the incorporation of additives therein to form lubricating oil compositions (i.e., formulations).

Representative additives typically present in such formulations include other viscosity modifiers, corrosion inhibitors, oxidation inhibitors, friction modifiers, other dispersants, anti-foaming agents, anti-wear agents, pour point depressants, detergents, rust inhibitors and the like.

Viscosity modifiers impart high and low temperature operability to the lubricating oil and permit it to remain shear stable at elevated temperatures and also exhibit acceptable viscosity or fluidity at low temperatures. These viscosity modifiers are generally high molecular weight hydrocarbon polymers including polyesters. The viscosity modifiers may also be derivatized to include other properties or functions, such as the addition of dispersancy properties.

These oil soluble viscosity modifying polymers will generally have weight average molecular weights of from about 10,000 to 1,000,000, preferably 20,000 to 500,000, as determined by gel permeation chromatography or light scattering methods.

Representative examples of suitable viscosity modifiers are any of the types known to the art including polyisobutylene, copolymers of ethylene and propylene, polymethacrylates, methacrylate copolymers, copolymers of an unsaturated dicarboxylic acid and vinyl compound, interpolymers of styrene and acrylic esters, and partially hydrogenated copolymers of styrene/isoprene, styrene/butadiene, and isoprene/butadiene, as well as the partially hydrogenated homopolymers of butadiene and isoprene.

Corrosion inhibitors, also known as anti-corrosive agents, reduce the degradation of the metallic parts contacted by the lubricating oil composition. Illustrative of corrosion inhibitors are phosphosulfurized hydrocarbons and the products obtained by reaction of a phosphosulfurized hydrocarbon with an alkaline earth metal oxide or hydroxide, preferably in the presence of an alkylated phenol or of an alkylphenol thioester, and also preferably in the presence of an alkylated phenol or of an alkylphenol thioester, and also preferably in the presence of carbon dioxide. Phosphosulfurized hydrocarbons are prepared by reacting a suitable hydrocarbon such as a terpene, a heavy petroleum fraction of a $C_2$ to $C_6$ olefin polymer such as polyisobutylene, with from 5 to 30 wt. % of a sulfide of phosphorus for ½ to 15 hours, at temperature in the range of about 66 to about 316° C. Neutralization of the phosphosulfurized hydrocarbon may be effected in the manner taught in U.S. Pat. No. 1,969,324.

Oxidation inhibitors, or antioxidants, reduce the tendency of mineral oils to deteriorate in service which deterioration can be evidenced by the products of oxidation such as sludge and varnish-like deposits on the metal surfaces, and by viscosity growth. Such oxidation inhibitors include alkaline earth metal salts of alkylphenolthioesters having preferably $C_5$ to $C_{12}$ alkyl side chains, e.g., calcium nonylphenol sulfide, barium toctylphenyl sulfide, dioctylphenylamine, phenylalphanaphthylamine, phospho-sulfurized or sulfurized hydrocarbons, etc.

Other oxidation inhibitors or antioxidants useful in this invention comprise oil-soluble copper compounds. The copper may be blended into the oil as any suitable oil soluble copper compound. By oil soluble it is meant that the compound is oil soluble under normal blending conditions in the oil or additive package. The copper compound may be in the cuprous or cupric form. The copper may be in the form of the copper dihydrocarbyl thio- or dithio-phosphates. Alternatively, the copper may be added as the copper salt of a synthetic or natural carboxylic acid. Examples of same thus include $C_{10}$ to $C_{18}$ fatty acids, such as stearic or palmitic acid, but unsaturated acids such as oleic or branched carboxylic acids such as napthenic acids of molecular weights of from about 200 to 500, or synthetic carboxylic acids, are preferred, because of the improved handling and solubility properties of the resulting copper carboxylates. Also useful are oil-soluble copper dithiocarbamates of the general formula $(R^{20}R^{21},NCSS)_zCu$ (where z is 1 or 2, and $R^{20}$ and $R^{21}$, are the same or different hydrocarbyl radicals containing from 1 to 18, and preferably 2 to 12, carbon atoms, and including radicals such as alkyl, alkenyl, aryl, aralkyl, alkaryl and cycloaliphatic radicals. Particularly preferred as $R^{20}$ and $R^{21}$, groups are alkyl groups of from 2 to 8 carbon atoms. Thus, the radicals may, for example, be ethyl, n-propyl, i-propyl, n-butyl, i-butyl, sec-butyl, amyl, n-hexyl, i-hexyl, n-heptyl, n-octyl, decyl, dodecyl, octadecyl, 2-ethylhexyl, phenyl, butylphenyl, cyclohexyl, methylcyclopentyl, propenyl, butenyl, etc. In order to obtain oil solubility, the total number of carbon atoms (i.e., $R^{20}$ and $R^{21}$,) will generally be about 5 or greater. Copper sulphonates, phenates, and acetylacetonates may also be used.

Exemplary of useful copper compounds are copper $Cu^I$ and/or $Cu^{II}$ salts of alkenyl succinic acids or anhydrides. The salts themselves may be basic, neutral or acidic. They may be formed by reacting (a) polyalkylene succinimides (having polymer groups of $M_n$ of 700 to 5,000) derived from polyalkylene-polyamines, which have at least one free carboxylic acid group, with (b) a reactive metal compound. Suitable reactive metal compounds include those such as cupric or cuprous hydroxides, oxides, acetates, borates, and carbonates or basic copper carbonate.

Examples of these metal salts are Cu salts of polyisobutenyl succinic anhydride, and Cu salts of polyisobutenyl succinic acid. Preferably, the selected metal employed is its divalent form, e.g., Cu+2. The preferred substrates are polyalkenyl succinic acids in which the alkenyl group has a molecular weight greater than about 700. The alkenyl group desirably has a $M_n$ from about 900 to 1,400, and up to 2,500, with a $M_n$ of about 950 being most preferred. Especially preferred is polyisobutylene succinic anhydride or acid. These materials may desirably be dissolved in a solvent, such as a mineral oil, and heated in the presence of a water solution (or slurry) of the metal bearing material. Heating may take place between 70° C. and about 200° C. Temperatures of 100° C. to 140° C. are entirely adequate. It may be necessary, depending upon the salt produced, not to allow the reaction to remain at a temperature above about 140° C. for an extended period of time, e.g., longer than 5 hours, or decomposition of the salt may occur.

The copper antioxidants (e.g., Cu-polyisobutenyl succinic anhydride, Cu-oleate, or mixtures thereof) will be generally employed in an amount of from about 50 to 500 ppm by weight of the metal, in the final lubricating or fuel composition.

Friction modifiers serve to impart the proper friction characteristics to lubricating oil compositions such as automatic transmission fluids.

Representative examples of suitable friction modifiers are found in U.S. Pat. No. 3,933,659 which discloses fatty acid esters and amides; U.S. Pat. No. 4,176,074 which describes molybdenum complexes of polyisobutyenyl succinic anhydride-amino alkanols; U.S. Pat. No. 4,105,571 which discloses glycerol esters of dimerized fatty acids; U.S. Pat. No. 3,779,928 which discloses alkane phosphonic acid salts; U.S. Pat. No. 3,778,375 which discloses reaction products of a phosphonate with an oleamide; U.S. Pat. No. 3,852,205 which discloses S-carboxyalkylene hydrocarbyl succinimide, S-carboxyalkylene hydrocarbyl succinamic acid and mixtures thereof; U.S. Pat. No. 3,879,306 which discloses N(hydroxyalkyl)alkenylsuccinamic acids or succinimides: U.S. Pat. No. 3,932,290 which discloses reaction products of di- (lower alkyl) phosphites and epoxides; and U.S. Pat. No. 4,028,258 which discloses the alkylene oxide adduct of phosphosulfurized N-(hydroxyalkyl) alkenyl succinimides. The disclosures of the above references are herein incorporated by reference. The most preferred friction modifiers are succinate esters, or metal salts thereof, of hydrocarbyl substituted succinic acids or anhydrides and thiobisalkanols such as described in U.S. Pat. No. 4,344,853.

Dispersants maintain oil insolubles, resulting from oxidation during use, in suspension in the fluid thus preventing sludge flocculation and precipitation or deposition on metal parts. Suitable dispersants include high molecular weight alkyl succinimides, the reaction product of oil-soluble polyisobutylene succinic anhydride with ethylene amines such as tetraethylene pentamine and borated salts thereof.

Pour point depressants, otherwise known as lube oil flow improvers, lower the temperature at which the fluid will flow or can be poured. Such additives are well known. Typically of those additives which usefully optimize the low temperature fluidity of the fluid are $C_8$–$C_{18}$ dialkylfumarate vinyl acetate copolymers, polymethacrylates, and wax naphthalene. Foam control can be provided by an antifoamant of the polysiloxane type, e.g., silicone oil and polydimethyl siloxane.

Anti-wear agents, as their name implies, reduce wear of metal parts. Representatives of conventional antiwear agents are zinc dialkyldithiophosphate and zinc diaryldithiosphate.

Detergents and metal rust inhibitors include the metal salts of sulphonic acids, alkyl phenols, sulfurized alkyl phenols, alkyl salicylates, naphthenates and other oil soluble mono- and dicarboxylic acids. Highly basic (viz. overbased) metal sales, such as highly basic alkaline earth metal sulfonates (especially Ca and Mg salts) are frequently used as detergents. Representative examples of such materials, and their methods of preparation, are found in co-pending Ser. No. 32,066, filed Mar. 27, 1987 now abandoned, the disclosure of which is hereby incorporated by reference.

Some of these numerous additives can provide a multiplicity of effects, e.g., a dispersant-oxidation inhibitor. This approach is well known and need not be further elaborated herein.

Compositions when containing these conventional additives are typically blended into the base oil in amounts which are effective to provide their normal attendant function. Representative effective amounts of such additives are illustrated as follows:

| Additive | Wt. % a.i. (Broad) | Wt. % a.i. (Preferred) |
|---|---|---|
| Viscosity Modifier | .01–12 | .01–4 |
| Corrosion Inhibitor | .01–5 | .01–1.5 |
| Oxidation Inhibitor | .01–5 | .01–1.5 |
| Dispersant | .1–20 | .1–8 |
| Pour Point Depressant | .01–5 | .01–1.5 |
| Anti-Foaming Agents | .001–3 | .001–0.15 |
| Anti-Wear Agents | .001–5 | .001–1.5 |
| Friction Modifiers | .01–5 | .01–1.5 |
| Detergents/Rust Inhibitors | .01–10 | .01–3 |
| Mineral Oil Base | Balance | Balance |

When other additives are employed it may be desirable, although not necessary, to prepare additive concentrates comprising concentrated solutions or dispersions of the V.I.-dispersant (in concentrate amounts hereinabove described), together with one or more of said other additives (said concentrate when constituting an additive mixture being referred to herein as an additive package) whereby several additives can be added simultaneously to the base oil to form the lubricating oil composition. Dissolution of the additive concentrate into the lubricating oil may be facilitated by solvents and by mixing accompanied with mild heating, but this is not essential. The concentrate or additive-package will typically be formulated to contain the V.I.-dispersant or multi-functional viscosity index improver additive and optional additional additives in proper amounts to provide the desired concentration in the final formulation when the additive-package is combined with a predetermined amount of base lubricant. Thus, the products of the present invention can be added to small amounts of base oil or other compatible solvents along with other desirable additives to form additive-packages containing active ingredients in collective amounts of typically from about 2.5 to about 90%, and preferably from about 5 to about 75%, and most preferably from about 8 to about 50% by weight additives in the appropriate proportions with the remainder being base oil.

The final formulations may employ typically about 10 wt. % of the additive-package with the remainder being base oil.

All of said weight percents expressed herein are based on active ingredient (a.i.) content of the additive, and/or upon the total weight of any additive-package, or formulation which will be the sum of the a.i. weight of each additive plus the weight of total oil or diluent.

This invention will be further understood by reference to the following examples, wherein all parts, unless otherwise indicated, are parts by weight and all molecular weights are number weight average molecular weights as noted, and which include preferred embodiments of the invention.

The following examples illustrate compositions falling outside the scope of the instant invention and are presented for comparative purposes only.

COMPARATIVE EXAMPLE 1

Into a reactor vessel are placed 500 grams of a 20 weight percent solution of maleic anhydride grafted ethylene-propylene copolymer (EPSA) (having a graft level of 0.102 milliequivalent of succinic anhydride per gram of grafted material, an ethylene content of about 42–45%, a propylene content of about 55–58%, and a $\overline{M}_n$ of about 30,000) in S100 NLP base oil. This solution is heated to 175° C. with stirring under a nitrogen atmosphere. To this reaction solution are added 34.55 grams a 80% oil solution of polybutenyl succinic anhydride (PIBSA) having a functionality of about 1.05 (a polybutene $\overline{M}_n$ of about 950, and a SAP number of 112 and about 12% unreacted polybutene) in 5100NLP base oil. The resultant mixture is mixed with nitrogen stripping for one hour and 5.7 grams of diethylenetriamine are added to this reaction mixture over a period of 15 minutes. The reaction mixture is then stripped with nitrogen for 15 minutes. At the end of the strip, 15.59 grams of alkyl sulfonic acid are added to the system as capping agent to cap the residual unreacted primary amine in the system.

COMPARATIVE EXAMPLE 2

A lubricating oil composition formulated to 10W40 specifications with a standard detergent inhibitor package and containing 12.52 weight % of the reaction product of Comparative Example 1 is prepared by adding said reaction product to said oil. The CCS at −20° C. in centipoise and the Kinematic Viscosity at 100° C. in centistokes of this fully formulated lubricating oil composition is determined, and the results are set forth in Table I.

The following Examples illustrate compositions of the instant invention.

EXAMPLE 3

The procedure of Comparative Example 1 is substantially repeated except that the low functionality polybutenyl succinic anhydride of Comparative Example 1 is replaced with 34.55 grams of polybutenyl succinic anhydride having a functionality of about 1.54 (having a polybutene $\overline{M}_n$ of about 950, and a SAP number of 157.9 and containing about 7.2% unreacted polybutene) in S100NLP base oil.

EXAMPLE 4

A lubricating oil composition formulated to 10W40 specifications with the standard detergent inhibitor package as used in Comparative Example 2 and containing 12.58 weight percent of the reaction product of Example 3 is prepared by adding said reaction product to said oil. The CCS at −20° C. in centipoise and the Kinematic Viscosity at 100° C. in centistokes of this fully formulated lubricating oil composition is determined, and the results are set forth in Table I.

EXAMPLE 5

The procedure of Comparative Example 1 is substantially repeated except that the low functionality polybutenyl succinic anhydride of Comparative Example 1 is replaced with 41.96 grams of a polybutenyl succinic anhydride having a functionality of about 1.33 (having a polybutene $\overline{M}_n$ of about 950, and a SAP number of 138.2 and containing about 12.7% unreacted polybutene) in S100NLP base oil.

EXAMPLE 6

A lubricating oil composition formulated to 10W40 specifications with the standard detergent inhibitor package as used in Comparative Example 2 and containing 12.40 weight percent of the reaction product of Example 5 is prepared by adding said reaction product to said oil. The CCS at −20° C. in centipoise and the Kinematic Viscosity at 100° C. in centistokes of this fully formulated lubricating oil composition is determined, and the results are set forth in Table I.

TABLE I

| | COMPARATIVE EXAMPLE 2 | EXAMPLE 4 | Example 6 |
|---|---|---|---|
| PIBSA Average Functionality | 1.05 | 1.54 | 1.33 |
| PIBSA Charge (wt. %) | 11.2 | 6.9 | 8.4 |
| PIBSA/EPSA Mole Ratio | 1.03 | 1.03 | 1.03 |
| Formulation Treat Rate in Oil wt. %) | 12.52 | 12.58 | 12.40 |
| K.V. in cSt at 100° C. | 15.07 | 14.99 | 14.97 |
| CCS in centipoise at −20° C. | 3749 | 3327 | 3427 |

As illustrated by the data in Table I the utilization of lower amounts of the high functionality polybutenyl succinic anhydride of the instant invention results in oil compositions having reduced low temperature viscosities while exhibiting substantially similar high temperature viscometric properties compared with oil compositions containing conventional multi-functional V.I. improver formulated using higher amounts of the low functionality polybutenyl succinic anhydride.

What is claimed is:

1. Lubricating oil multifunctional viscosity index improver-dispersant additive intended for lubricating oil compositions exhibiting improved low temperature viscometric properties comprising reaction product of:

(a) an oil soluble ethylene copolymer comprising from about 15 to 90 wt. percent ethylene and from about 10 to 85 wt. percent of at least one $C_3$ to $C_{28}$ alpha-olefin monomer, having a number average molecule weight of from about 5,000 to 500,000, grafted with ethylenically unsaturated carboxylic acid material having 1 or 2 acid moieties or anhydride moiety;

(b) polyamine having at least two primary amino groups; and (c) an amount of high functionality long chain hydrocarbyl substituted dicarboxylic acid or anhydride having an average functionality of at least 1.2 wherein said long chain hydrocarbyl is derived from olefin polymer having a number average molecular weight of from about 400 to about 10,000.

2. An additive according to claim 1 wherein said (c) is long chain hydrocarbyl substituted succinic acid or anhydride.

3. An additive according to claim 2 wherein said long chain hydrocarbyl is derived from olefin polymer of at least one $C_2$ to $C_{18}$ mono-olefin monomer, said olefin polymer having a $\overline{M}_n$ of from about 400 to about 5,000.

4. An additive according to claim 3 wherein said olefin polymer is derived from $C_4$ mono-olefin monomer and has a $\overline{M}_n$ of from about 400 to about 5,000.

5. An additive according to claim 4 wherein (c) is comprised of polyisobutenyl succinic anhydride.

6. An additive according to claim 1 wherein (c) has an average functionality of at least about 1.3.

7. An additive according to claim 6 wherein (c) has an average functionality of at least about 1.4.

8. An additive according to claim 1 wherein the amount of (b) used is an amount effective to provide from about 0.5 to about 1.5 equivalents of primary amine per acid equivalent of the dicarboxylic acid material present in (a).

9. An additive according to claim 1 wherein said (a) comprises a copolymer consisting essentially of about 30 to 80 wt. percent ethylene and about 20 to 70 wt. percent propylene, having a number-average molecular weight in the range of about 10,000 to 200,000 grafted with maleic anhydride.

10. An additive according to claim 1 wherein said polyamine is diethylene triamine.

11. An additive according to claim 1 formed by simultaneously reacting (a), (b) and (c) with removal of water.

12. An additive according to claim 1 wherein said (b) and (c) are first pre-reacted, followed by reaction with said (a).

13. An additive according to claim 1 wherein (c) has a functionality from 1.2 to about 2.0.

14. An additive according to claim 13 wherein said (c) has a functionality from 1.3 to about 1.9.

15. A lubricating oil composition exhibiting improved low temperature viscometric properties comprising lubricating oil and at least a viscosity index improving effective amount of viscosity index improver-dispersant comprising reaction product of (a) oil soluble ethylene copolymer comprising from about 15 to 90 wt. percent ethylene and from about 10 to 85 wt. percent of at least one $C_3$ to $C_{28}$ alpha-olefin monomer, having a number average molecule weight of from about 5,000 to 500,000, grafted with ethylenically unsaturated mono- or dicarboxylic acid or anhydride;

(b) polyamine having at least two primary amino groups; and (c) an amount of high functionality long chain hydrocarbyl substituted dicarboxylic acid or anhydride having an average functionality of at least 1.2 wherein said long chain hydrocarbyl is derived from olefin polymer having a number average molecular weight of from about 400 to about 10,000.

16. A lubricating oil composition according to claim 15 which contains from about 0.01 to 15 wt. percent of said viscosity index improver dispersant.

17. A lubricating oil composition according to claim 15 wherein (a) comprises a copolymer of about 30 to 80 wt. percent ethylene and about 20 to 70 wt. percent propylene, having a number-average molecular weight of about 10,000 to 200,000 grafted with maleic anhydride.

18. A lubricating oil composition according to claim 15 wherein said polyamine is polyalkylene or polyoxyalkylene polyamine containing alkylene or oxyalkylene groups of about 2 to 7 carbon atoms, and containing 2 to 11 nitrogens.

19. A lubricating oil composition according to claim 18 wherein said polyalkylene polyamine is diethylene triamine.

20. A lubricating oil composition according to claim 15 wherein said polyamine is polyoxyalkylene polyamine wherein the oxyalkylene groups contain 2 to 7 carbons, the number of oxylalkylene groups is from about 3 to 70, and the number of nitrogens is about 2 to 11.

21. A lubricating oil composition according to claim 15 wherein (c) is a polyalkenyl succinic anhydride.

22. A lubricating oil composition according to claim 21 wherein said polyalkenyl has a $\overline{M}_n$ from about 400 to about 5,000.

23. A lubricating oil composition according to claim 22 wherein said polyalkenyl is polybutenyl.

24. A lubricating oil composition according to claim 21 wherein said polyalkenyl succinic anhydride has a functionality of at least about 1.3.

25. A lubricating oil composition according to claim 24 wherein said polyalkenyl succinic anhydride has a functionality of at least 1.4.

26. A lubricating oil composition according to claim 15 wherein (a) is comprised of an ethylenepropylene copolymer grafted with maleic anhydride, wherein (b) is polyamine, and wherein (c) is comprised of polyisobutenyl succinic anhydride.

27. A lubricating oil concentrate comprising 5–50 percent by weight of the additive of claim 1.

* * * * *